US009611011B2

(12) United States Patent
Jarng

(10) Patent No.: US 9,611,011 B2
(45) Date of Patent: Apr. 4, 2017

(54) APPRATUS FOR MOORING FLOATER USING SUBMERGED PONTOON

(71) Applicant: Tony Youngjoo Jarng, Gyeongsangnam-do (KR)

(72) Inventor: Tony Youngjoo Jarng, Gyeongsangnam-do (KR)

(73) Assignee: Haeseung Hitec Co., Ltd., Gyeongsangnam-do (KR)

( * ) Notice: Subject to any disclaimer, the term of this patent is extended or adjusted under 35 U.S.C. 154(b) by 0 days.

(21) Appl. No.: 14/767,283

(22) PCT Filed: Mar. 2, 2014

(86) PCT No.: PCT/KR2014/000919
§ 371 (c)(1),
(2) Date: Aug. 11, 2015

(87) PCT Pub. No.: WO2014/126349
PCT Pub. Date: Aug. 21, 2014

(65) Prior Publication Data

US 2015/0375828 A1 Dec. 31, 2015

(51) Int. Cl.
*B63B 21/50* (2006.01)
*B63B 35/34* (2006.01)
(Continued)

(52) U.S. Cl.
CPC ..... *B63B 21/50* (2013.01); *B63B 22/02* (2013.01); *B63B 35/34* (2013.01);
(Continued)

(58) Field of Classification Search
CPC ..... B63B 35/34; B63B 21/50
(Continued)

(56) References Cited

U.S. PATENT DOCUMENTS 3,588,796 A * 6/1971 Armistead ..... G01S 3/8036 114/144 B
5,515,803 A * 5/1996 Korsgaard ..... B63B 22/023 114/230.13
(Continued)

FOREIGN PATENT DOCUMENTS

GB 9312951 * 8/1993 ..... B63B 22/023
JP 09-509382 9/1997
(Continued)

OTHER PUBLICATIONS

International Search Report, mailing date Jun. 20, 2014 for corresponding International Application No. PCT/KR2014/000919 with English translation.
(Continued)

*Primary Examiner* — Lars A Olson
*Assistant Examiner* — Jovon Hayes
(74) *Attorney, Agent, or Firm* — Intellectual Property Law Group LLP

(57) ABSTRACT

A mooring apparatus using a submerged pontoon that does not interfere with floaters and sailing vessels, is not affected by oceanic weather conditions by being submerged at a constant depth, easily separates the floater such as FPSO from the submerged pontoon, in order to cope with an emergency such as stormy weather and avoids collision, and, upon the emergency being terminated, enables the floater such as FPSO to return to the operation area and moor to the submerged pontoon and start the operation. An apparatus for mooring a floater using a submerged pontoon including a submerged pontoon that is placed and fixed at a constant depth below the bottom of the floater, wherein the submerged pontoon is fabricated with buoyant pipes, assumes a planar polygon, is lashed by ropes that are
(Continued)

connected to weights or anchors on the seabed and is lashed by ropes that are connected to the floater.

9 Claims, 5 Drawing Sheets

(51) Int. Cl.
*B63B 22/02* (2006.01)
*B63B 21/00* (2006.01)
*B63B 35/44* (2006.01)

(52) U.S. Cl.
CPC ... *B63B 2021/006* (2013.01); *B63B 2022/028* (2013.01); *B63B 2035/448* (2013.01)

(58) Field of Classification Search
USPC ..... 114/230.2
See application file for complete search history.

(56) References Cited

U.S. PATENT DOCUMENTS 5,609,442 A * 3/1997 Horton ..... B63B 9/065 405/196
6,148,751 A * 11/2000 Brown ..... B63B 1/34 114/264
6,431,107 B1 * 8/2002 Byle ..... B63B 21/502 114/264
6,811,355 B2 * 11/2004 Poldervaart ..... B63B 21/50 114/230.1
8,347,804 B2 * 1/2013 Van Loenhout ..... B63B 21/50 405/223.1
8,764,346 B1 * 7/2014 Srinivasan ..... B63B 21/502 405/223.1
2015/0375828 A1 * 12/2015 Jarng ..... B63B 22/02 114/230.2

FOREIGN PATENT DOCUMENTS

JP 2011-520699 7/2011
KR 10-2010-0114186 A 10/2010
KR 10-2012-0079447 A 7/2012
RU 2145933 2/2000

OTHER PUBLICATIONS

Civil Engineering Laboratory (USA), Technical Report 815.

* cited by examiner

APPRATUS FOR MOORING FLOATER USING SUBMERGED PONTOON

BACKGROUND

Technical Field

The present invention relates to an apparatus for mooring a floater using a submerged pontoon and, more specifically, to an apparatus for mooring a floater using a submerged pontoon that secures a floater such as floating production storage and offloading on the surface of the sea, the depth of which is about 50 m or more below sea level or deep sea.

Background Art

In drilling and producing offshore petroleum and gas, a floater such as floating production storage and offloading (hereinafter referred to as "FPSO") is to be moored on the surface of the sea, the depth of which is 50 m or more below sea level or deep sea, for which various mooring systems are referred to in related patent documents.

1. Spread Mooring: A mooring system that is mostly applied in the shallow sea and is difficult to disassemble and reconstruct after the initial construction. This is a technology to fix and moor a floater by dropping anchors and anchor ropes directly to the seabed from the floater such as FPSO, wherein a plurality of anchors and anchor ropes are radially distributed with the floater such as FPSO at the center of anchors and anchor ropes.

2. Internal Turret Mooring: A mooring system that pierces a hole on the bottom surface of a floater such as FPSO to install an internal turret from which a plurality of anchor ropes are radially lashed in order to connect the mooring ropes to the floater. The turret that lashes the mooring ropes is also used as a connecting path for the petroleum production piping of the oil well and, for this purpose, a swivel that is a rotating joint is installed. A swivel is expensive and, upon a failure or damage, may cause an accident such as crude oil leakage thus produced. The floater rotates on the turret in the direction of wind, avoiding cross winds in heavy weather, thus effectively coping with stormy weather. However, in extremely heavy weather, the floater is to be separated, for protection, from the turret and kept out of the mooring system. It requires a relatively long time and considerable efforts to reassemble the turret when the floater returns to the operation area after stormy weather.

3. External Turret Mooring: A mooring system in which the internal turret employed in an internal turret mooring system is to be installed frontward outside a floater such as FPSO. This is an expensive rotating equipment for the purpose of connecting and mooring the petroleum production piping of the oil well and poses a chance for leakage at the swivel that is a rotating joint. This system is difficult, after the initial construction, to disassemble, recover and reassemble for an emergency 4. Catenary Anchor Leg Mooring (CALM): A mooring system that lashes a floating structure with a plurality of anchor ropes that radially extend to secure the floating structure at a position and moors a floater such as FPSO to the floating structure. This is economic but does not firmly secure at an exact position.

5. Single Anchor Leg Mooring (SALM): Similar to a CALM abovementioned, but lashes a floating structure with a single anchor rope and moors a floater such as FPSO to the floating structure. This is economic as well as easy to operate in the deep sea, but hard to moor at an exact position.

6. Dynamic Positioning (DP): Instead of external lashing equipment such as anchor rope, this system utilizes, beneath the bottom of a floater such as FPSO, a plurality of thrusters that can rotate 360 degrees, receives positioning data from satellites and continuously controls the direction and speed of the thrusters in order to keep the floater at a constant position. Although propitious in the deep sea, it requires a high amount of costs for installation and continuous operation.

7. Tower Mooring: A system available only in the shallow sea that builds up an offshore tower founded in the seabed and moors a floater such as FPSO to the tower.

As a non-patent literature such as a technical report, issued by Civil Engineering Laboratory (USA) describes a mooring system that submerges individual buoys in the sea. The system is to secure a smaller installation, instead of a floater, such as buoy at a certain position.

As described, existing mooring methods are difficult, after constructing a floater such as FPSO on the sea surface, to separate the floater off the position including collision avoidance in a short period when an emergency occurs such as stormy weather and requires a considerable amount of time, after the emergency, in returning to the original position and reconstructing the floater. A mooring system according to CALM or SALM technique is easy to operate but disadvantageous in keeping an exact position and developing an oil well of a large scale. Furthermore, those systems require high costs according to the species of mooring equipment, and, if employing rotating crude oil production piping, are vulnerable to leakage of the crude oil thus produced, materials reinjected to the oil well, etc.

PRIOR ART DOCUMENTS

Patent Documents

Patent Document 1: US Notice of Publication of Registration U.S. Pat. No. 8,347,804 (Jan. 8, 2013)

Patent Document 2: US Notice of Publication of Registration U.S. Pat. No. 5,515,803 (May 14, 1996)

Patent Document 3: British Notice of Publication of Laying open No. 9,312,951 (Aug. 4, 1993)

Patent Document 4: Russian Notice of Publication of Laying open No. 2,145,933 (Feb. 27, 2000)

Non-Patent Literature

Non-Patent Literature 1: Civil Engineering Laboratory (USA), Technical Report 815

SUMMARY OF INVENTION

Technical Problem

To resolve the problems, the present invention provides an apparatus for mooring a floater using a submerged pontoon that secures a floater and a riser pipe that transports the crude oil produced below the seabed by constructing a submerged pontoon at a constant depth below the sea level not to be affected by heavy waves and interfere with sailing vessels then lashing the floater by means of additional ropes or chains that are connected to the submerged pontoon.

Technical Solution

To achieve the objectives, the present invention provides, in order to secure an offshore floater, an apparatus for mooring a floater using a submerged pontoon including a submerged pontoon that is placed and fixed at a constant depth below the bottom of the floater, wherein the submerged pontoon is fabricated with buoyant pipes to assume a planar polygon, is lashed by ropes that are connected to weights or anchors on the seabed and is lashed by ropes that are connected to the floater.

The submerged pontoon may be required to be fabricated into a closed one-piece pipe or with two or more pipes, which are occluded at both ends, intersecting with each other to form one or more of linear, crossed and tri-pronged structures, and extend to the positions of adjacent floaters.

The internal cross-section of the pipes that constitute the submerged pontoon may be required to be any one of occlusion type that assumes any one shape of a circle, an ellipse or a polygonal, open type that is open at an end or fin type that has, internally or externally, along the length of the pipe, a fin structure in one or more longitudinal, horizontal or diagonal directions.

The ropes may be required to be include two or more pontoon mooring ropes each end of a side of which is connected to each of one or more weights on the seabed while the ends of the other side of which are connected to the submerged pontoon; two or more anchor ropes each end of a side of which is connect to each of one or more anchors on the seabed while the ends of the other side of which are connected to the submerged pontoon; and two or more floater mooring ropes the ends of a side of which are connected to the floater while the ends of the other side are connected to the submerged pontoon.

The submerged pontoon may be required to include one or more stays that connect vertexes or corners that face each other or sit oppose to each other or points between the two corners to make diagonals or quasi-diagonals.

The floater mooring ropes may be required to include a buoy that is to be connected by an extension lead after an end of the floater mooring rope is disconnected from the floater.

The buoy may be required to be equipped with a self-descending buoyancy controller that automatically submerges and emerges by generating and eliminating, respectively, buoyancy in response to ultrasonic signals.

The floater may be required to be equipped with a length controller that winds or releases the rope to control the rope length by measuring the change in the draft of the floater and the tension of the rope according to buoyancy change.

The submerged pontoon may be required to include a buoyancy regulator that increases or decreases the buoyancy by means of any one of a piston system that makes water be charged to or discharged from compartments and a compressed air supplier that injects water into compartments by opening a valve or pushes against water by injecting compressed air into the compartments.

Advantageous Effects of Invention

An apparatus for mooring a floater using a submerged pontoon provided by the present invention does not interfere with floaters and sailing vessels, is not affected by oceanic weather conditions by submerging at a constant depth, easily separates the floater such as FPSO, in order to cope with an emergency such as stormy weather and avoid collision, from the submerged pontoon and, upon the emergency being terminated, returns to the operation area to moor the floater such as FPSO to the submerged pontoon and start the operation.

DETAILED DESCRIPTION

An apparatus for mooring a floater using a submerged pontoon will now be described in detail with reference to accompanying drawings.

Figure 1:
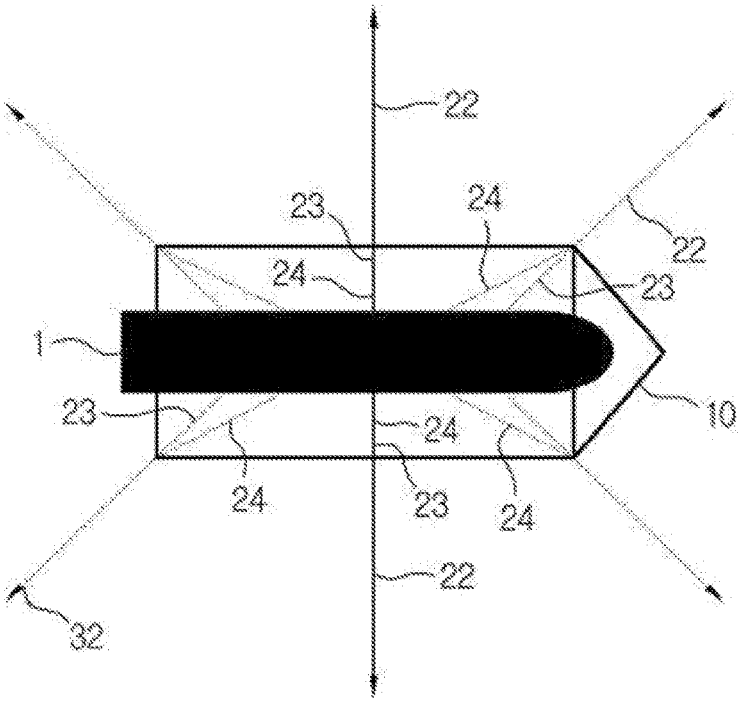
FIG. 1 is a top view of an apparatus for mooring a floater using a submerged pontoon according to an embodiment of the present invention.
Figure 2:
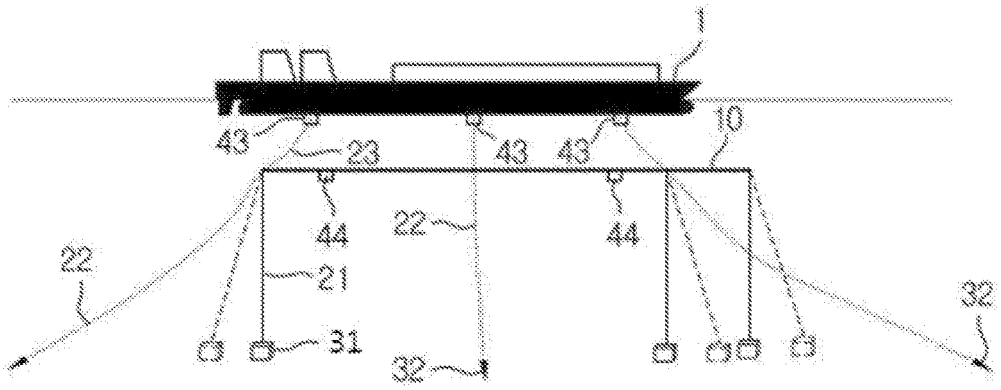
FIG. 2 is a lateral view of an apparatus for mooring a floater using a submerged pontoon according to an embodiment of the present invention.
Figure 3:
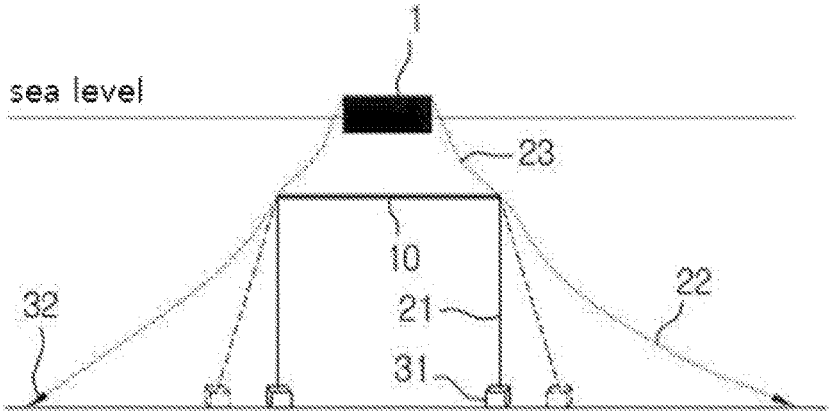
FIG. 3 is a front view of an apparatus for mooring a floater using a submerged pontoon according to an embodiment of the present invention.

FIGS. 1, 2 and 3 are a top, lateral and front view, respectively, of an apparatus for mooring a floater using a submerged pontoon according to an embodiment of the present invention. An apparatus for mooring a floater using a submerged pontoon provided by the present invention is, as illustrated in the FIGs, a mooring system that configures a pontoon structure (hereinafter referred to as a "submerged pontoon") of pipes that are cylindrical or hollow in any other shapes, have a certain amount of buoyancy and form various shapes such as rectangle, pentagon, etc. to correspond to the construction conditions of a floater such as FPSO, fixes and positions the submerged pontoon at a constant depth in the sea by laying down one or more weights or anchors (hereinafter referred to as "weights") made of concrete, etc. on the seabed and connecting the weights to the submerged pontoon via ropes, etc. and secures one or more floaters such as FPSO at certain position(s) on the sea by lashing the floater(s) to the submerged pontoon by means of a plurality of ropes.

To achieve the objectives, the present invention is connected to a submerged pontoon 10 and ropes including weights 31 and pontoon mooring ropes 21 that determine the vertical position of the submerged pontoon 10 in the sea, radially arrayed anchors 32 and anchor ropes 22 that determine the horizontal position of the submerged pontoon 10 and floater mooring ropes 23 that lash a floater 1 to the submerged pontoon 10.

The submerged pontoon 10 is fabricated with hollow or cylindrical pipe structures that have a certain amount of buoyancy and form a planar polygon that is a line, curve or polygon or a combination of curves according to the planar geometry of the floater 1.

A submerged pontoon 10 according to this embodiment assumes the shape of a pentagon according to the planar geometry of a floater 1 in which the geometry converges to a point on a side.

For the submerged pontoon 10, a single closed pipe or a plurality of pipes that are occluded at both ends may form various shapes with one or more intersections such as line, cross, tri-prong, etc.

In addition, the submerged pontoon 10 may extend to the position of each of 2nd and 3rd floaters, etc. that are to be moored in the proximity of the floater in order to receive and transport the product such as crude oil from the floater.

The submerged pontoon 10 may extend along a riser pipe that transports the crude oil drilled out of an oil well below the seabed to fix the riser pipe.

The submerged pontoon 10 may assume the shape of one or more symmetric or asymmetric polygons that are connected to each other while part or the whole of the polygon(s) may be curved.

The internal cross-section of the pipes that constitute the submerged pontoon 10 may be a closed circle, ellipse or polygon or open in one or more directions or have fins arrayed longitudinally, horizontally or diagonally or in a combined way of those arrays on either internal or external surface of the pipes.

The internal surface and external surface of the pipes that constitute the submerged pontoon may or may not be made of an identical material. For example, the inside of the pipes of the submerged pontoon 10 may be hollow or filled with polystyrene in part or in whole to generate buoyancy.

The submerged pontoon 10 may take a shape that corresponds to the entire planar geometry of a plurality of floaters in order to moor the floaters.

The submerged pontoon 10 is connected by the one or more weights 31 and as many pontoon mooring ropes 21.

The weight 31, like concrete, etc., has a weight that equals or exceeds that of the buoyancy of the submerged pontoon and each of the one or more, as necessary, weights is connected, being positioned on the seabed, to each of the pontoon mooring ropes 21.

The pontoon mooring rope 21 is connected to the submerged pontoon 10 at an end and to the weight 31 at the other end to fix the submerged pontoon 10 at a constant depth.

The pontoon mooring rope 21 is connected to the submerged pontoon 10 vertically upward from the weight 31.

Meanwhile, a plurality of the anchor ropes 22 are equipped with one or more of the anchors 32 and radially arrayed on the seabed with the submerged pontoon 10 as the center in order to horizontally fix the submerged pontoon 10 at a constant position.

More specifically, the anchor ropes 22, radially arrayed with the submerged pontoon 10 as the center, are connected to the weights on a side and to the submerged pontoon 10 on the other side at a regular intervals.

Here, the submerged pontoon 10 may be required to be connected by one or more stays 24 in order to retain the shape of the structure and hold up the tension transferred from the anchor ropes 22.

The stays 24 connect a diagonal (quasi-symmetry) by connecting the vertexes or corners that face each other or sit opposite to each other or one or more points between the vertexes or corners of the submerged pontoon 10 via diagonals or lines that are almost symmetric to each other (quasi-diagonals) in order to prevent the submerged pontoon from being distorted in a certain direction.

The floater mooring ropes 23 connect a plurality of points in the floater 1 that is located above the submerged pontoon 10 to a plurality of points in the submerged pontoon 10. Here, the floater mooring rope 23 may be required to connected, at a certain position, to the stay 24 of the submerged pontoon 10 and, at another position, to a point in the floater 1 that corresponds to the stay 24.

In addition, if the floater mooring rope 23 is disconnected from the connection point in the floater 1, the floater mooring rope 23 may be connected to an extension lead a buoy tied up that will be described below.

Figure 7:
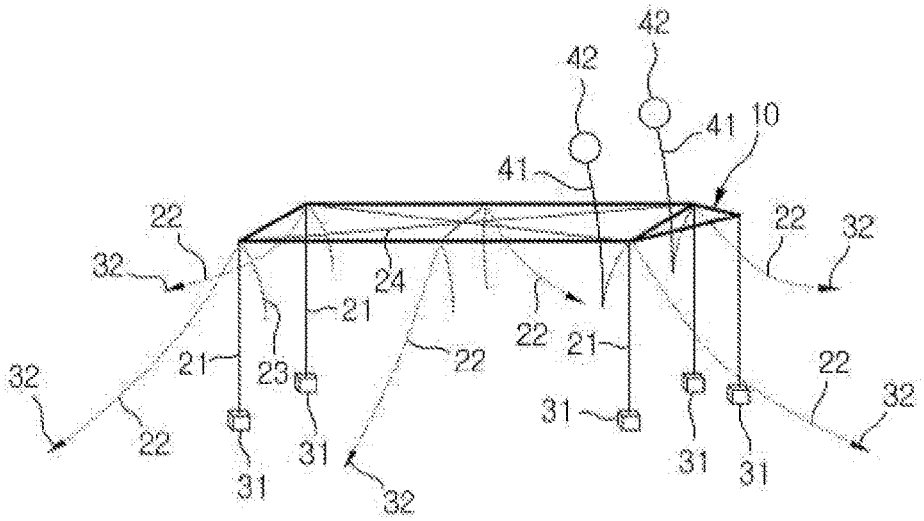
FIG. 7 illustrates a state where a submerged pontoon is left alone in the sea.
Figure 8:
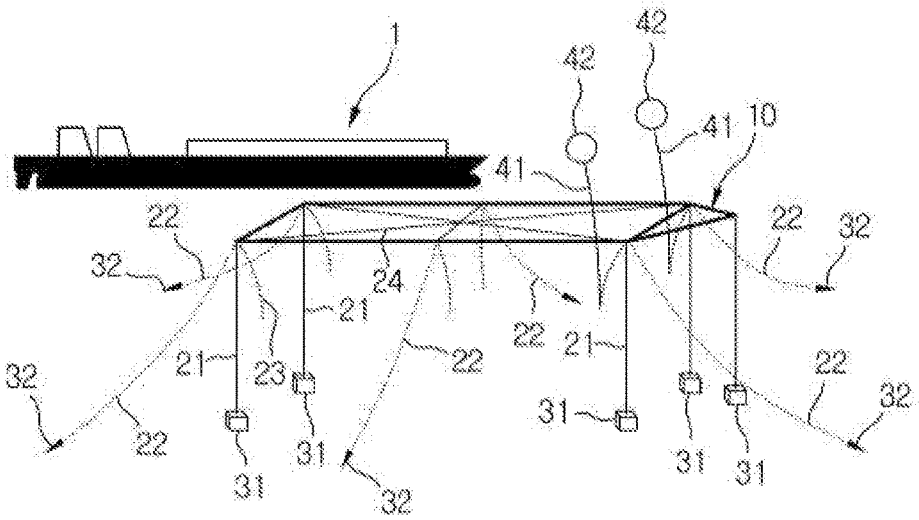
FIG. 8 illustrates a state where a floater returns onto a submerged pontoon after an emergency is terminated.

As illustrated in FIGS. 7 and 8, the floater mooring rope 23 that is disconnected and submerged from the floater 1 is to be, when the floater mooring rope 23 is disconnected from the floater 1, connected to an extension lead 41 that lashes the buoy 42 at the end opposite to the buoy 42.

The buoy 42 is equipped with a self-descending buoyancy controller that self-controls the buoyancy of the buoy 42 to make the buoy 42 submerge and emerge as necessary by, in response to a signal such as ultrasonic wave, opening a valve to inject water into the buoy 42 and by, in response to a signal, pushing against water by means of compressed air supplied by an embedded compressed air tank.

Therefore, the floater mooring ropes 23 need not to be collected via an additional work by means of a remotely operated vehicle (ROV) and the floater 1 resumes the offshore operation within a short period by picking up the extensions leads 41 tied up with the buoys 42 that emerges to the surface in response to a signal to collect the floater mooring ropes 23 and by connecting the floater 1 to the submerged pontoon 10 to recover the mooring system, which minimizes working time losses that would otherwise require high costs.

Meanwhile, in order to keep the floater 1 moored effectively by holding the floater mooring ropes 23 tense that are connected to the floater, the floater 1 may be equipped with a length controller 43 that controls the length of the floater mooring ropes 23 by winding or releasing the floater mooring ropes 23 with reference to the draft of the floater that varies according to the change in the buoyancy caused by the cargo load of the floater.

Here, the length controller 43 controls the length by measuring, then according to, the tension applied to the floater mooring ropes 23 or the change in the draft thus detected.

In addition, a buoyancy regulator 44 is installed in the submerged pontoon 10 in order to make the buoyancy of the submerged pontoon 10 be slightly larger than the specific gravity of seawater so that the submerged pontoon 10 naturally descends or ascends according to the vertical change in the draft of the floater 1.

For this purpose, the buoyancy regulator 44 makes the buoyancy of the submerged pontoon 10 be larger or smaller than the specific gravity of seawater by making seawater charged to or discharged from the compartments for buoyancy regulation so that the submerged pontoon 10 emerges from or submerges into the sea.

In other words, the buoyancy regulator 44 makes the submerged pontoon 10 have a negative (−) or positive (+) value of buoyancy according to the change in the draft of the floater or the extent to which the floater emerges from or submerges into the sea so that the submerged pontoon 10 descends or ascends along with the floater 1.

Here, the buoyancy regulator 44 may be required to have, as means for regulating the buoyancy of the submerged pontoon 10, a buoyancy regulation system that employs a piston system that decreases the buoyancy by injecting water into the compartments or, on the contrary, increases the buoyancy by compelling water to be expelled from the compartments.

Alternatively, the buoyancy regulator 44 may use a compressed air supplier that includes a self-descending buoyancy controller identical to that of the buoyancy control mechanism of the buoy as previously described.

In other words, the buoyancy regulator 44 opens a valve in response to a signal such as ultrasonic wave to inject water into the buoy and decrease, and finally eliminate, the buoyancy and, in response to a signal, on the contrary, lets in compressed air from the embedded compressed air tank to push against the water so that the buoy self-descends and self-ascends.

The buoyancy regulator 44 according to the present invention is positioned outside the submerged pontoon 10, as illustrated in FIG. 2, but not limited thereto, and is positioned inside the pipe of the submerged pontoon 10.

Figure 4:
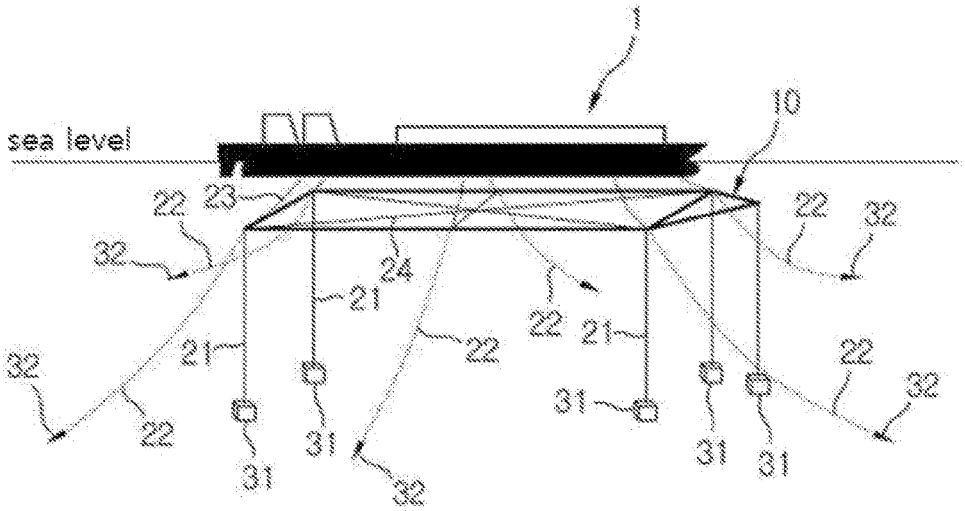
FIG. 4 is a perspective view of a floater that is in service, moored to a submerged pontoon.

In addition, the buoyancy regulator 44 may position one or more of the compartments inside or outside the submerged pontoon. Therefore, as illustrated in FIG. 4, the floater 1 and the submerged pontoon 10 are moored by means of the ropes, etc.

Figure 5:
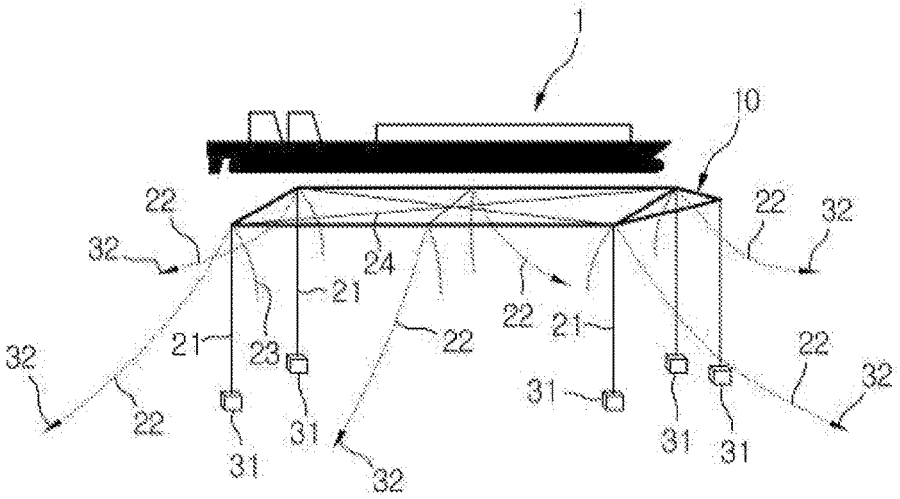
FIG. 5 illustrates a state where ropes and chains of a submerged pontoon are disconnected to avoid collision with a floater.
Figure 6:
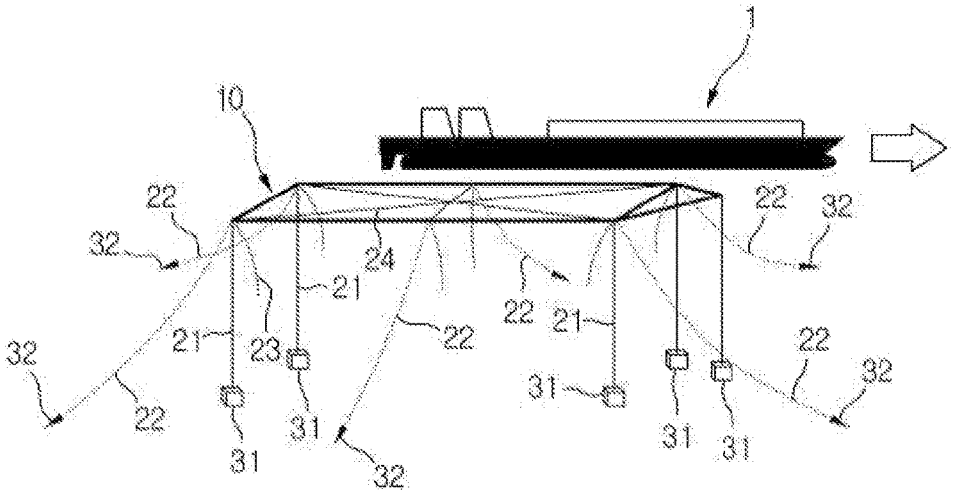
FIG. 6 illustrates a state where a floater is released from and leaves a submerged pontoon.

In this state, if the floater 1 is required to move to another position or avoid collision with another structure during operating the floater 1 due to an emergency such as stormy weather as illustrated in FIG. 5, the floater mooring ropes 23 of the floater 1 are disassembled from the floater 1 and the floater 1 moves off the operation area, as illustrated in FIG. 6.

Correspondingly, as illustrated in FIG. 7, the submerged pontoon 10 remains in the operation area with the floater mooring ropes 23 that have been disconnected from the floater 1 submerging in the sea.

Here, upon being disconnected from the floater 1, the floater mooring rope 23 in the sea is connected to the extension lead 41 that is connected to the buoy 42 at the end opposite to the buoy 42.

The buoy 42 may be required to be self-descending in order to self-descend and self-ascend by eliminating and generating the buoyancy in response to a signal such as ultrasonic wave, which needs not additionally collect the floater mooring ropes 23 by means of a ROV and, instead, simply collects the floater mooring ropes 23 by picking up the extension leads 41 tied up with the buoys, connects the floater 1 to the submerged pontoon 10, recovers the mooring system then finally resumes the offshore operation of the floater 1 within a short period in order to minimize working time losses that would otherwise require high costs.

Figure 9:
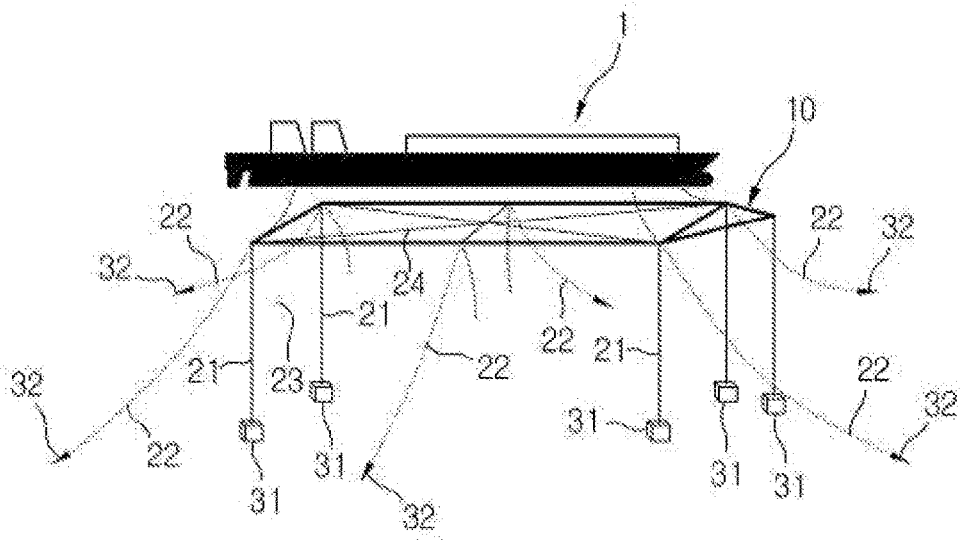
FIG. 9 illustrates a state where a floater is moored to a submerged pontoon.

In addition, after an emergency is terminated, the floater 1 returns to the position above the submerged pontoon 10 as illustrated in FIG. 8 while the floater mooring ropes 23 are connected consecutively to the floater 1 as illustrated in FIG. 9.

The present invention has so far illustrated and described with reference to, but not limited to, a preferred embodiment. It is clear that the present invention may be achieved to other variations and modifications by a person skilled in the art within the scope of the thoughts of the present invention and within the scope of the Claims and equivalents thereof.

REFERENCE NUMERALS

1: Floater
10: Submerged pontoon
21: Pontoon mooring rope
22: Anchor rope
23: Floater mooring rope
24: Stay
31: Weight
32: Anchor
41: Extension lead
42: Buoy
43: Length controller
44: Buoyancy regulator

What is claimed is:

1. An apparatus for mooring a floater using a submerged pontoon including a submerged pontoon that is placed and fixed a constant depth below the bottom of the floater, wherein the submerged pontoon is fabricated with buoyant pipes to assume a planar polygon, lashed by ropes that are connected to weights or anchors on a seabed, and lashed by ropes that are connected to the floater.

2. The apparatus for mooring a floater using a submerged pontoon of claim 1, wherein the submerged pontoon configured into a closed one-piece pipe or with two or more pipes, which are occluded at both ends, intersecting with each other to form one or more of linear, crossed and tri-pronged structures, extend to the positions of adjacent floaters.

3. The apparatus for mooring a floater using a submerged pontoon of claim 1, wherein the internal cross-section of the pipes that constitute the submerged pontoon is any one of an occluded shape that assumes any one shape of a circle, an ellipse or a polygonal, open shape that is open at an end or fin shaped that has, internally or externally, along the length of the pipe, a fin structure in one or more longitudinal, horizontal or diagonal directions.

4. The apparatus for mooring a floater using a submerged pontoon of claim 1, wherein the ropes includes two or more pontoon mooring ropes, one end of each pontoon mooring rope is connected to each of one or more weights on the seabed while the other end of each pontoon mooring rope is connected to the submerged pontoon; two or more anchor ropes, one end of each anchor rope is connected to each of one or more anchors on the seabed while the other end of each anchor rope is connected to the submerged pontoon; and two or more floater mooring ropes, one end of each floater mooring rope is connected to the floater while the other end of each floater mooring rope is connected to the submerged pontoon.

5. The apparatus for mooring a floater using a submerged pontoon of claim 4, wherein the submerged pontoon includes one or more stays that connect vertexes or corners that face each other or sit oppose to each other or points between the two corners to make diagonals or quasi-diagonals.

6. The apparatus for mooring a floater using a submerged pontoon of claim 4, wherein the floater mooring ropes includes a buoy that is to be connected by an extension lead after an end of the floater mooring rope is disconnected from the floater.

7. The apparatus for mooring a floater using a submerged pontoon of claim 6, wherein the buoy is equipped with a self-descending buoyancy controller that automatically submerges and emerges by generating and eliminating, respectively, buoyancy according to ultrasonic signals.

8. The apparatus for mooring a floater using a submerged pontoon of claim 1, wherein the floater is equipped with a length controller that winds or releases the rope to control the rope length by measuring the change in the draft of the floater and the tension of the rope according to buoyancy change.

9. The apparatus for mooring a floater using a submerged pontoon of claim 1, wherein the submerged pontoon includes a buoyancy regulator that increases or decreases the buoyancy by means any one of a piston system that make water be charged to or discharged from compartments and a compressed air supplier that injects water into compartments by opening a valve or pushes against water by injecting compressed air into the compartments.

* * * * *